US009096358B2

(12) United States Patent
Bailey

(10) Patent No.: US 9,096,358 B2
(45) **Date of Patent: *Aug. 4, 2015**

(54) CUP LID FOR BEVERAGES WITH FOAM

(71) Applicant: Craig Bailey, Camas, WA (US)

(72) Inventor: Craig Bailey, Camas, WA (US)

(73) Assignee: FOAMAROMA LLC, Camas, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/138,895

(22) Filed: Dec. 23, 2013

(65) Prior Publication Data

US 2014/0110418 A1 Apr. 24, 2014

Related U.S. Application Data

(63) Continuation of application No. 13/335,833, filed on Dec. 22, 2011, now Pat. No. 8,733,583, which is a continuation-in-part of application No. 12/619,670, filed on Nov. 16, 2009, now abandoned, and a continuation-in-part of application No. 29/396,206, filed on Jun. 27, 2011, now Pat. No. Des. 658,059.

(51) Int. Cl.

| | |
|---|---|
| ***A47G 19/22*** | (2006.01) |
| ***B65D 51/16*** | (2006.01) |
| ***B65D 43/02*** | (2006.01) |
| *B65D 25/40* | (2006.01) |

(52) U.S. Cl.

CPC ..... *B65D 51/1611* (2013.01); *B65D 43/0212* (2013.01); *B65D 2543/00046* (2013.01); *B65D 2543/00092* (2013.01); *B65D 2543/00296* (2013.01); *B65D 2543/00537* (2013.01); *B65D 2543/00731* (2013.01); *B65D 2543/00796* (2013.01)

(58) Field of Classification Search

USPC ..... 220/713, 717, 704, 712, 716, 711

See application file for complete search history.

(56) References Cited

U.S. PATENT DOCUMENTS

| | | | | |
|---|---|---|---|---|
| 6,419,112 | B1 * | 7/2002 | Bruce et al. | 220/781 |
| 7,134,570 | B1 * | 11/2006 | Heath et al. | 220/717 |
| 7,959,029 | B2 * | 6/2011 | Whitaker et al. | 220/719 |
| 8,733,583 | B2 * | 5/2014 | Bailey | 220/713 |
| 2002/0027137 | A1 * | 3/2002 | Price et al. | 220/23.87 |
| 2006/0169707 | A1 * | 8/2006 | Walz et al. | 220/780 |
| 2007/0131691 | A1 * | 6/2007 | Evans | 220/254.5 |
| 2008/0000921 | A1 * | 1/2008 | Leon | 220/713 |

* cited by examiner

*Primary Examiner* — Mickey Yu
*Assistant Examiner* — Niki Eloshway
(74) *Attorney, Agent, or Firm* — Cooper & Dunham LLP

(57) ABSTRACT

A lid for a beverage cup includes an annular mounting portion to removably, sealingly, engage the open lip of a round beverage cup; a raised annular ridge inset from the mounting portion extending from a first end to a second end; a central portion spanning the annulus and including an aroma aperture at the center; a dispensing portion spanning between the annular ridge first end and second end including a front flat portion, a sloped dispensing aperture surface, and a dispensing aperture disposed on the sloped surface, the dispensing aperture comprising a triangle with rounded corners having a base proximate and parallel to the intersection edge and an apex proximate the upper edge; and, the raised annular ridge and dispensing portion defining a continuous containment surrounding the central portion.

9 Claims, 9 Drawing Sheets

CUP LID FOR BEVERAGES WITH FOAM

CROSS-REFERENCE TO RELATED APPLICATION

This application is a continuation of and claims priority to co-pending U.S. Utility patent application Ser. No. 13/335,833, filed Dec. 22, 2011, which is a continuation-in-part of and claims priority to co-pending U.S. Design patent application Ser. No. 29/396,206, filed Jun. 27, 2011, and co-pending U.S. Nonprovisional patent application Ser. No. 12/619,670 filed Nov. 16, 2009, the disclosures of each of which is hereby incorporated by reference.

FIELD OF THE INVENTION

The present invention relates to beverage cup lids for beverages which include foam, whipped cream, or similar top layers.

BACKGROUND

Its all about the foam. Espresso-based drinks topped with foam and/or whipped cream have become ubiquitous of late. Espresso drinkers enjoy the foam topping which results from steaming milk prior to adding it to the espresso coffee. The resulting top layer of foam adds texture and richness for the consumer. The foam also filters the steam rising from the coffee, enhancing the coffee aroma—which also enhances the beverage flavor, as olfactory stimulation has significant impact on taste. Oftentimes, espresso drinks are topped with a dollop of whipped cream as well, which also enhances the experience by turning a simple espresso or mocha into a full-fledged dessert.

Baristas take pride in their ability to lay over just the right amount of foam to enhance the drink experience and frequently manipulate the foam layer to create visual artistry. For some baristas, their visual foam designs have become akin to their signatures on consumable works of art. Making and drinking espresso has become almost a ritual for many espresso aficionados, and the foam is an important element of the overall experience.

Traditionally, espresso drinks are served in an open-topped cup which allows the drinker to take in foam and/or whipped cream with the liquid coffee portion to regulate the temperature and richness as she wishes, and which also stimulates the olfactory senses as she sips, because her nose is right over the drink. Frequently, however, beverages are purchased "to go" such that the vendor is obligated to place a disposable beverage lid onto the beverage cup to prevent spillage.

Unfortunately, conventional beverage lids tend to prevent the espresso drinker from drawing both coffee and foam (or whipped cream) at the same time. The placement and shape of the drink holes allow the liquid coffee portion through, but block the foam and/or whipped cream. The drinker ends up ingesting a solid stream of hot liquid into their mouth, denied the relative cooling effect of drinking a mixture of liquid and foam. In addition the espresso drinker, denied the rich texture of the foam and/or whipped cream during consumption, removes the lid when finished to find substantial quantities of rich foam remaining and wonders what it was all for.

Conventional beverage lids also tend to block the nose from getting a proper whiff of the wonderful coffee aroma, although that rich aroma is often what drew people to start drinking coffee in the first place. Again, the espresso drinker's experience is limited and she may wonder why she has paid so dearly for a halfway experience.

Thus, there is a need for a beverage lid designed for use with foam-topped beverages which permits a drinker to consume the foam topping concurrently with the liquid portion of the beverage, and which links the olfactory senses to the drinking experience.

SUMMARY AND ADVANTAGES

A lid for a beverage cup includes an annular mounting portion to removably, sealingly, engage the open lip of a round beverage cup; a raised annular ridge inset from the mounting portion, the annual ridge extending circumferentially from a first end to a second end; a central portion spanning the annulus defined by the raised annular ridge, the central portion including an aroma aperture disposed at the center of the central portion; a dispensing portion spanning between the annular ridge first end and second end, the dispensing portion including a front flat portion extending from a bottom edge to a top edge, a sloped dispensing aperture surface extending from the top edge to an intersection edge intersecting central portion, and a dispensing aperture disposed on the sloped surface, the dispensing aperture comprising a triangle with rounded corners having a base proximate and parallel to the intersection edge and an apex proximate the top edge; and, the raised annular ridge and dispensing portion defining a continuous containment surrounding the central portion.

A beverage cup lid may include wherein the dispensing aperture defines a wide end breadth and a narrow end breadth, and the wide end breadth is approximately twice the magnitude of the narrow end breadth.

A beverage cup lid may include wherein the containment deck is substantially planar, and further wherein the containment deck is approximately coplanar to the top edge of the beverage cup.

A beverage cup lid may include wherein the aroma aperture diameter is approximately equal to the drink hole aperture radial axis length.

A beverage cup lid may include wherein the drink hole aperture radial axis length is approximately 0.4 inches (10 mm).

A beverage cup lid may include wherein the radiused corners have radii of approximately 0.08 inches (2 mm).

A beverage cup lid may include wherein the dispensing portion top edge is a radiused edge, the radius being at least 0.03 inches (0.75 mm).

A beverage cup lid may include wherein the dispensing portion upper edge is coplanar with the top wall of the raised annular ridge.

The beverage cup lid of the present invention presents numerous advantages.

Foam Problem

With an espresso drink, the small drink hole in a conventional lid makes it difficult to get foam at the same time with the steamed milk and espresso. Also, if you look at the underside of a conventional lid you'll see that the depression in the lid for the upper lip restricts access for the foam to get to the drink hole.

Applicant's invention provides a uniquely shaped and oriented drink hole on an angled surface. The angled surface gives the drink hole access to the foam at all tilt angles of the cup. The drink hole is tall enough to allow the consumer to get foam at the same time with the steamed milk and espresso. With the inverted triangular shape there is more room for the foam to get through the top of the hole thus increasing the foam to liquid ratio. The consumer can easily control the amount of foam and coffee by varying the position of the lips and the amount of cup tilt. Side-by-side tests show that with the present invention, there is very little foam left in the cup after finishing the drink. With the conventional lid a lot of the foam is left in the cup.

Aroma Problem

It is difficult to smell the coffee aroma with conventional lids. As with wine tasting, a major contribution to the overall sensory experience is from the sense of smell.

Applicant's invention incorporates an air vent hole positioned under the nose to allow the coffee or tea aroma to be enjoyed by the consumer. The consumer may exhale into the cup just prior to drinking to provide a gentle blast of coffee aroma right at the nostrils.

Temperature Problem

Most conventional lids have a small hole forcing the consumer to ingest 100% hot liquid. Also, with the conventional lid it is difficult to slurp air with the hot liquid to cool it down while maintaining a good lip seal to the lid. For lattes and cappuccinos, foam is mostly air and is much cooler than the hot milk.

Applicant's invention provides an inverted trapezoidal drinking hole design, allowing the consumer to vary the amounts of foam and liquid thus controlling the temperature of the drink, thus reducing the chance of a burned tongue. Also, with a regular coffee or tea one is able to slurp air through the drink hole because the vent hole is appropriately sized. When hot liquid is aerated it rapidly cools, permitting the consumer to drink the beverage immediately with lowered risk of mouth burns.

Nose Fit Problem

Conventional lids have a top surface where the drinker's nose hits, forcing the drinker to tilt their head back.

However, the depression in Applicant's invention provides space for the nose allowing the consumer to fully tilt the cup with less tilting of the head, which may permit the consumer to more conveniently drink espresso while driving or walking.

Spillage Control Problem

Baristas often complain that if the cup is filled with the level of foam above the top of the cup and a conventional lid is put on foam may ooze out of the hole down the outside of the cup causing a mess and wasting time for cleanup, or requiring a new cup and lid. Consumers sometimes complain that with conventional lids the spillage squirts out of the lid drink hole. This is caused by water hammer effect, as the liquid mass hits the drink hole across its entire cross section nearly simultaneously with contacting the adjacent lid surface, creating a high pressure spike which ejects liquid through the drink hole.

If foam comes out of the hole while putting on lid embodying Applicant's invention, the foam is contained in the center of the lid. (The first sip is actually quite enjoyable with the foam contained in the lid.) Additionally, the contours of Applicant's lid act as a dam to reduce any spillage and typically it actually takes a vigorous shake of the cup on purpose to create any spillage. If there is spillage, the liquid does not "hammer" the drink hole region, but rises along the length of the drink hole relieving pressure by dribbling into the containment area.

Straw Problem

The drinking hole in the conventional lid is so small you have to pinch big straws to fit it through. Sometimes the straw stays pinched making it difficult to drink. However, with Applicant's lid, drink and aroma holes are large enough to easily accommodate two large straws.

Flavor Enhancement

Applicant's invention provides holes appropriately sized to allow the consumer to slurp air with the coffee, thereby atomizing the liquid into small droplets. This atomization process coats the tongue and inside of the mouth with the droplets which enhances the flavor. Like in wine tasting and cupping (coffee tasting) one draw some air into one's mouth with the drink and exhales through the nose. This liberates the coffee aromas and allows them to reach the olfactory senses where they can be detected. This improves regular coffee and tea, as well.

No Pucker

Many conventional lids require the consumer to pucker his mouth to seal against the raised area around the drink hole. The drink hole shape and orientation of Applicant's invention enables the consumer to create a good seal around the drink hole with a relaxed mouth, similar to the feeling using an open top cup.

Drink Hole Alignment Aid

The drink hole in Applicant's invention is centered in an area between the annular ridges. A flat spot is provided along the front of the drink hole, which can be felt with the bottom lip. Both of these design shapes help the consumer to align their mouth to the drink hole without looking.

Visual Indication of Liquid Level

With Applicant's invention, the liquid level can be seen through the drink and aroma holes. This allows the consumer to gauge how far the cup needs to be tilted to reach the liquid which helps to alleviate the anxiety around guessing when the hot liquid will get to the drink hole.

The dispensing aperture is aimed away from the consumer towards the center of the lid. In case of spillage the liquid will be contained within the containment reservoir and has the opportunity to drain back into the cup through the aroma hole or the consumer can drink it.

The dispensing aperture is on a slanted surface designed to be parallel and even with the top of the liquid when the cup is full and tilted for drinking. This allows the foam floating on the top of the hot milk to easily flow unobstructed to and out of the dispensing aperture from the first to the last sip.

The dispensing aperture is twice as wide at the top as at the bottom to allow a higher volume ratio of foam to hot coffee/milk. This improves the enjoyment of the foam. Also, the air bubbles in the foam are at a lower temperature than the hot liquid, so provide cooling when taken in together with the hot liquid. The hot coffee/milk thus allowing the consumer to cool the drink by taking more foam.

The dispensing aperture and aroma hole have enough cross-section area to facilitate air flow for the consumer to slurp air through the aroma hole and out the dispensing aperture while drinking. This simulates the in-shop coffee mug experience allowing the consumer to cool a non-foam drink (plain coffee or tea) and to aspirate the liquid in the mouth for enhanced flavor.

The dispensing aperture has large radius corners as not to catch the lip in the bottom corner and provide more efficient flow. With a tight radius corner the upper lip sometimes becomes wedged into the bottom corner as the consumer finishes the sip and slides away from the lid.

The leading edge of the straight dispensing aperture surface has a large radius corner to make it feel more like a thick ceramic mug to the tongue and lips.

The front surface is flat in front of the dispensing aperture. This combined with the gap in the annular ridge aids the consumer in finding the dispensing aperture without looking.

The annular ridge height is maintained for the entire circumference to create a spillage containment area.

The aroma hole is positioned directly under the drinker's nose.

The containment reservoir is recessed allowing more room for the drinker's Nose.

The perimeter seal that snaps around the cup rim roll is compatible with standard cup dimensions for the 12-24 oz sizes.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Figure 1:
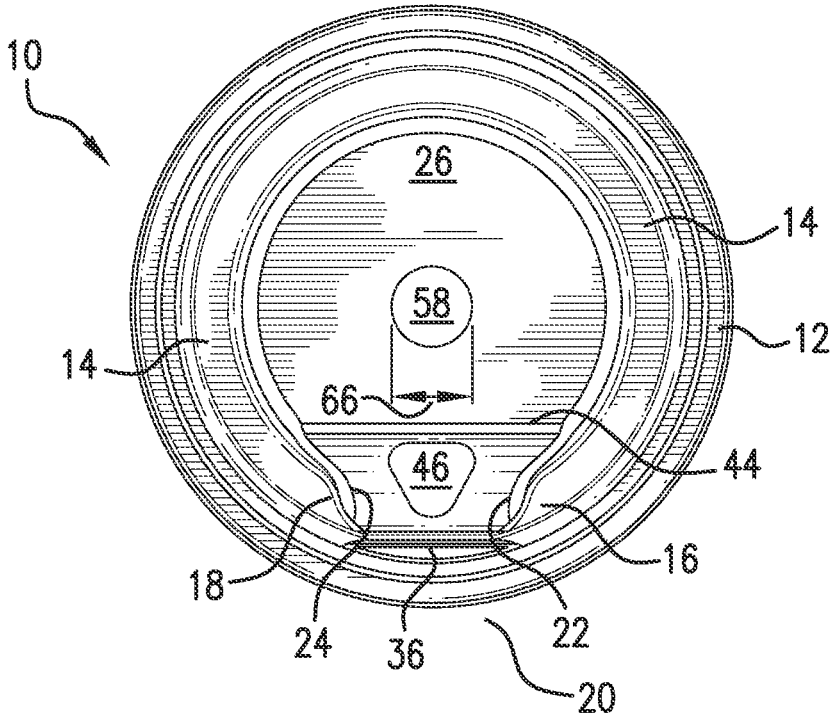
FIG. 1 shows a top plan view of a first embodiment.
Figure 2:
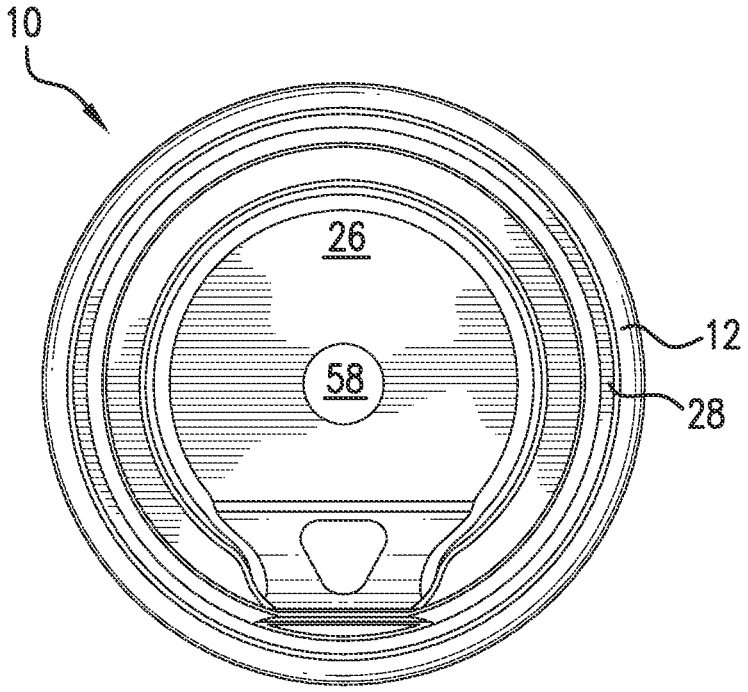
FIG. 2 shows a bottom plan view of a first embodiment.
Figure 3:
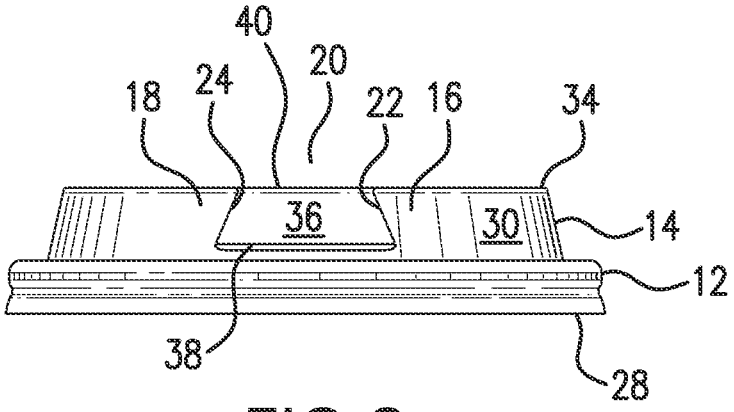
FIG. 3 shows a front (drinking side) edge view of a first embodiment.
Figure 4:
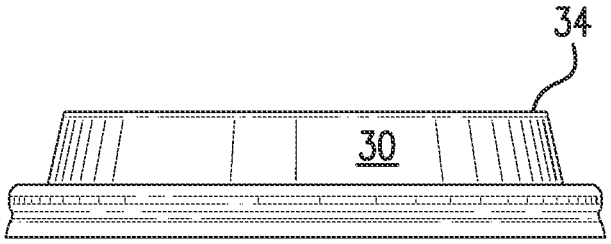
FIG. 4 shows a back edge view of a first embodiment.
Figure 5:
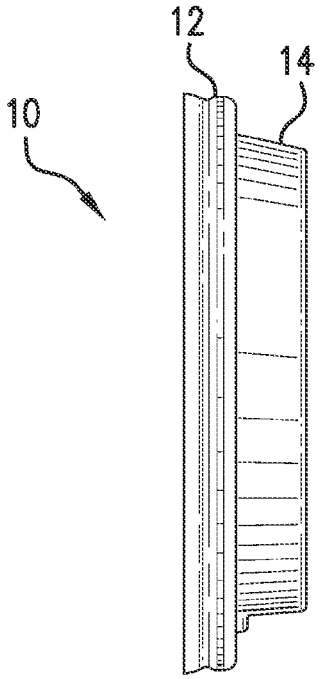
FIG. 5 shows a right edge view of a first embodiment.
Figure 6:
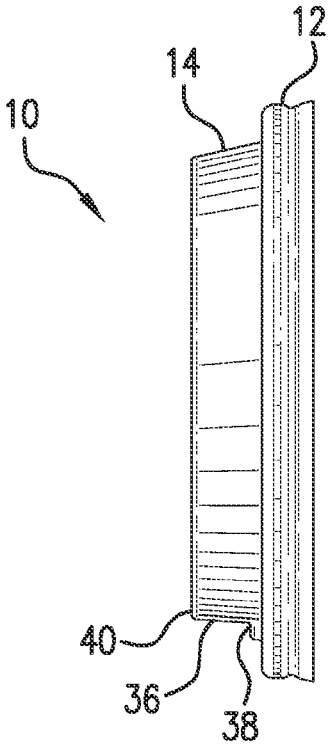
FIG. 6 shows a left edge view of a first embodiment.
Figure 7:
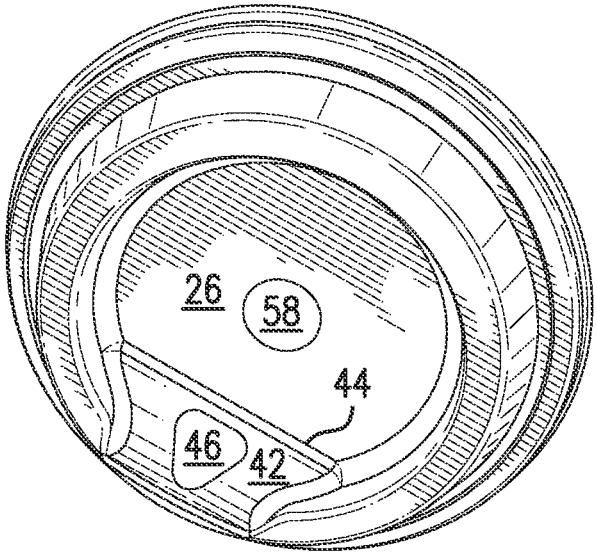
FIG. 7 shows a top perspective view of a first embodiment.
Figure 8:
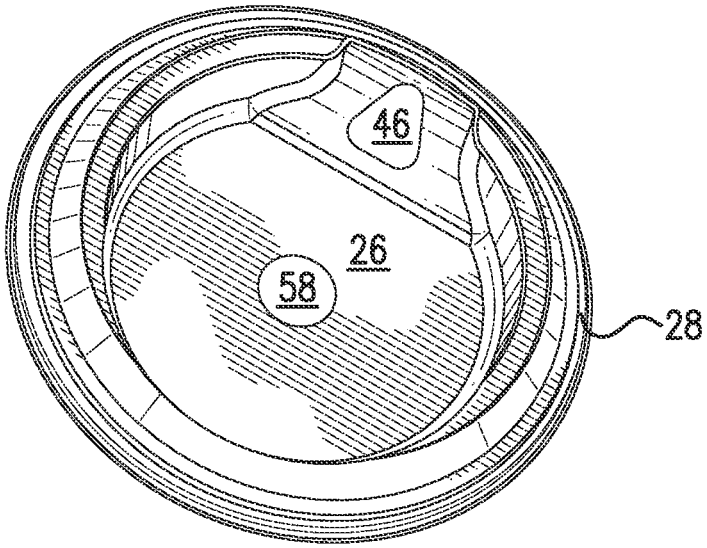
FIG. 8 shows a bottom perspective view of a first embodiment.
Figure 9:
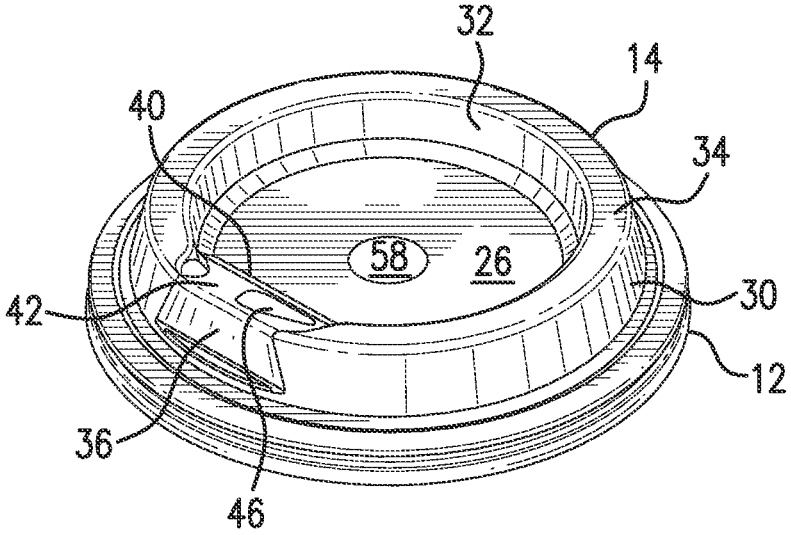
FIG. 9 shows a front perspective view of a first embodiment.
Figure 10:
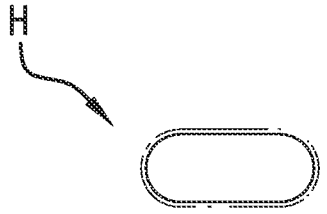
FIG. 10 shows a beverage cup drink hole of conventional prior art design, for illustration.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Directional descriptors in the Description and Claims are referenced to the normal installed orientation of a beverage lid on a cup. Thus, the "top" or "upper" surface of a drink lid corresponds to the outer or exposed surface of the lid when correctly installed on a cup, and the "bottom" or "lower" surface corresponds to the interior surface of the lid when correctly installed. The "front" or "forward" part of a beverage lid refers to the portion proximate the drink hole which will also be proximate the consumer when in use, and the "back" or "rearward" part of a beverage lid refers to the portion opposing the "front" portion, despite the conventionally circular shape of a beverage cup lid.

Referring to FIGS. 1-9, 11, 14 and 14*a*, an embodiment 10 of a disposable beverage cup lid for foamed beverages is shown, sized for a standard 12 oz. (355 ml) hot beverage cup. As shown in FIGS. 1-9, a beverage cup lid 10 comprises an annular mounting portion 12, a raised annular ridge portion 14 inset from the mounting portion and projecting upward therefrom, the ridge portion 14 extending circumferentially from a first end 16 to a second end 18, a dispensing portion 20 spanning from a first end 22 adjoining ridge first end 16 to a second end 24 adjoining ridge second end 18, and a center portion 26 spanning the region enclosed by ridge portion 14 and dispensing portion 20. Center portion 26 includes an aroma aperture 58 disposed at the center of center portion 26 and concentric with annular mounting portion 12.

Annular mounting portion 12 includes an underside groove 28 for removably engaging the top rim of a beverage cup to form a liquid-tight seal. Annular mounting portion 12 is circular, to engage the circular rim of a beverage cup.

Annular ridge portion 14 includes an outer wall 30, a concentric inner wall 32, and a connecting top wall 34 spanning between. In the embodiment, annular ridge portion 14 extends approximately 0.4 inches (10 mm) above the plane of a beverage cup top lip L when lid 10 is mounted on a cup C. In the embodiment, annular ridge outer and inner walls 30 and 32 slope slightly away from vertical toward each other so as to be farther apart at their bases than at their top edges meeting at top wall 34.

Dispensing portion 20 includes a substantially vertical front flat 36 spanning from dispensing portion first end 22 to second end 24, and extending from base 38 to dispensing portion upper edge 40. Dispensing portion 20 further includes a substantially planar sloped surface 42 extending from upper edge 40 downward to intersect along a lower edge 44 intersecting with central portion 26, and spanning between dispensing portion first end 22 to second end 24. In the embodiment, central portion 26 is a flat surface, approximately coplanar with the top lip L of a cup C when lid 10 is mounted to a cup C.

Dispensing aperture 46 is disposed on sloped surface 42 centered between dispensing portion first and second ends 22 and 24. Dispensing aperture 46 generally forms a triangle having first, second and third sides 48, 50 and 52, respectively. Dispensing aperture 46 is symmetric about a first radial axis 54 which is aligned radially outward, and a second transverse axis 56 is perpendicular to first axis 54. Dispensing aperture 46 includes first, second and third large radius corners 60, 62 and 64.

Figure 11:
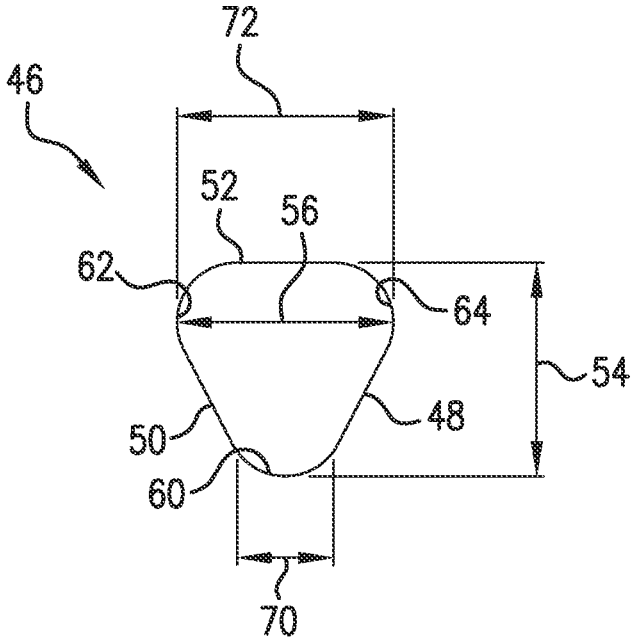
FIG. 11 shows an isolation view of the drink hole geometry of a first embodiment of the invention.
Figure 12:
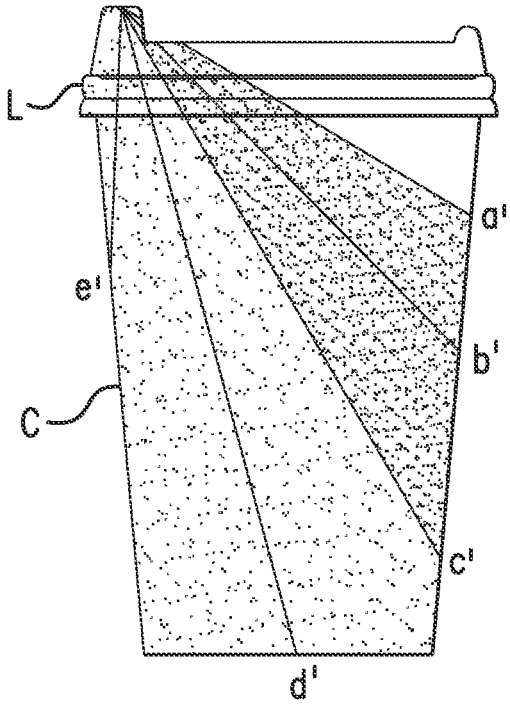
FIG. 12 shows a cup side view of a first conventional prior art design beverage lid with the conventional drink hole design of FIG. 10, demonstrating operation, for illustration.
Figure 12A:
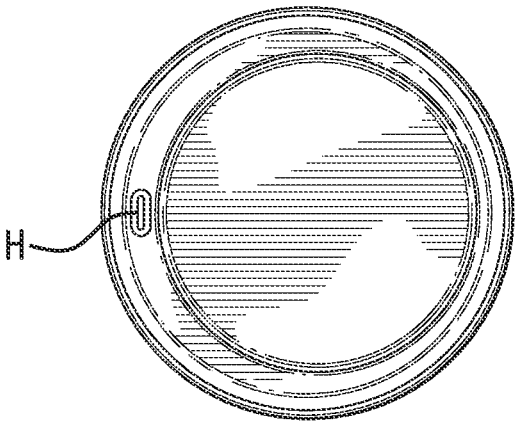
FIG. 12*a* shows a lid top view corresponding to FIG. 12.
Figure 13:
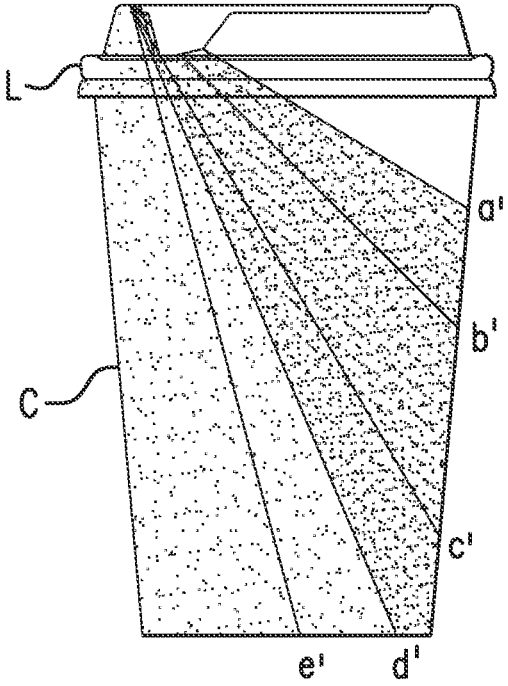
FIG. 13 shows a cup side view of a second conventional prior art design beverage lid with the conventional drink hole design of FIG. 10, demonstrating operation, for illustration.
Figure 13A:
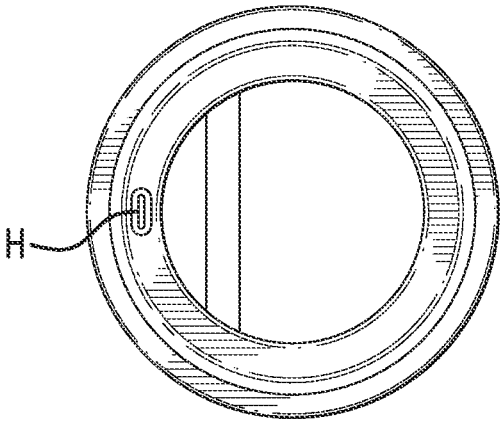
FIG. 13*a* shows a lid top view corresponding to FIG. 13.

Dispensing aperture 46 is oriented with its apex (first radiused corner 60) oriented toward dispensing portion upper edge 40, and third side 52 proximate and parallel to sloped surface lower intersecting edge 44. Having the wider portion of dispensing aperture 46 oriented downslope permits floating foam to more easily pass through dispensing aperture 46 when the cup is tilted up by the user. Referring to FIG. 11, dispensing aperture 46 has a narrow end breadth 70 measured across the region where the radiused curvature of radiused corner 60 begins, and a wide end breadth 72 measured across the widest portion of dispensing aperture 46 at radiused corners 62 and 64. In the embodiment, wide end breadth 72 is approximately twice the magnitude of narrow end breadth 70. This proportion provides for reliable flow ratio of foam to liquid. Sloped surface 42 is sloped in the range 20° to 45° from horizontal for efficiency and comfort. In the embodiment, sloped surface 42 is approximately 30°, which provides for efficient dispensing of liquid and foam through most cup tilt angles.

In the embodiment, aroma aperture 58 is circular, having a diameter 66 approximately equal to dispensing aperture first radial axis 54. In the embodiment, dispensing aperture first, second and third radius corners 60, 62, 64 have radii of approximately 0.08 inches (2 mm), and the diameter 66 of aroma aperture 58 is approximately 0.4 inches (10 mm). The large radius corners provide smoother combined flow of liquid and foam through dispensing aperture 46, and prevent injury to the user's lips.

Referring to FIGS. 10-14*a*, comparison to conventional designs is shown. FIGS. 10, 12 & 12*a*, and 13 & 13*a* show the shape of a conventional hot beverage cup lid drink hole H—basically oval, with the long axis oriented transversely—as used with conventional lid profiles, and how they function at various tilt angles. Various cup tilt angles are indicated by lines a', b', c', d' and e', with a' being the shallowest in each case (i.e. a full cup) and e' being the greatest tilt (i.e. a nearly empty cup). The dark shaded regions indicate tilt regions where surface foam is blocked from the dispensing hole—in other words, no foam will pass through the drink hole at all. FIGS. 12, 12*a* and 13, 13*a* show that essentially no foam will pass through the drink holes of conventional beverage cup lids until the cup is at least half empty, and even then the narrow transverse orientation of the drink holes H.

Figure 14:
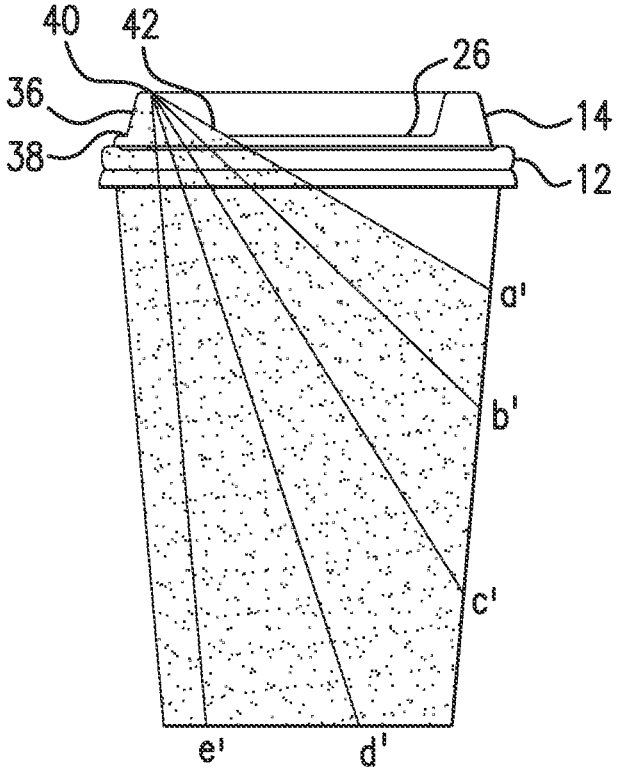
FIG. 14 shows a cup side view of a first embodiment of the invention, with the inventive drink hole design of FIG. 11, demonstrating operation.
Figure 14A:
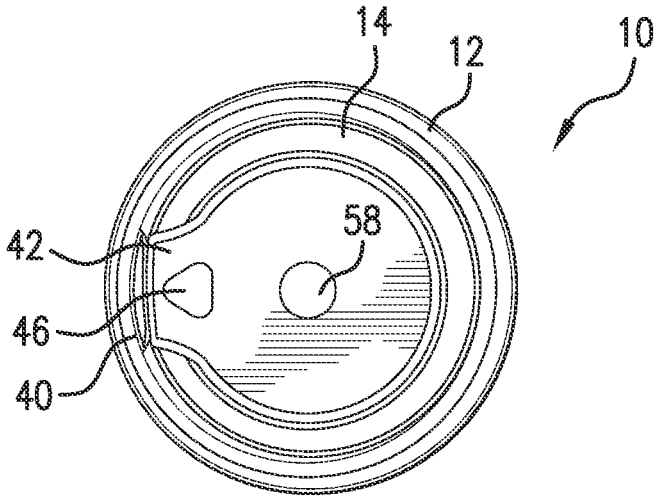
FIG. 14*a* shows a lid top view corresponding to FIG. 14.

By contrast, FIGS. 14, 14*a* show that in Applicant's design, foam reaches the drink hole 46 at virtually every angle, including when the cup is full. Additionally, if anything spills out through aroma hole 58, it either drains back into the cup, or is contained by ridge portion 14 and dispensing portion 20, to drain into users mouth when he takes a sip of espresso. Additionally, when drinking from the cup, aroma hole 58 is aligns approximately with the user's nostrils to provide olfactory stimulation, while the displacement depth provided by central portion 26 prevents actual contact with the nose except at relatively extreme angles.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A beverage cup lid, comprising:

an annular mounting portion to removably, sealingly, engage the open lip of a round beverage cup;

a raised annular ridge inset from the mounting portion, the annular ridge extending circumferentially from a first end to a second end spaced apart from the first end;

a central portion spanning the annulus defined by the raised annular ridge, the central portion including an aroma aperture disposed at the center of the central portion;

a dispensing portion spanning between the annular ridge first end and second end, the dispensing portion including a front flat portion extending from a bottom edge to a upper edge, a planar sloped dispensing aperture surface extending from the upper edge to an intersection edge intersecting the central portion, and a dispensing aperture disposed on the sloped surface, the dispensing aperture comprising a triangle with rounded corners having a base proximate and parallel to the intersection edge and an apex proximate the upper edge;

the raised annular ridge and dispensing portion defining a continuous containment surrounding the central portion.

2. The beverage cup lid as in claim 1, further comprising:

wherein the dispensing aperture defines a wide end breadth and a narrow end breadth, and the wide end breadth is approximately twice the magnitude of the narrow end breadth.

3. The beverage cup lid as in claim 1, further comprising:

wherein the central portion is substantially planar, and further wherein the containment deck is approximately coplanar to the lip of the beverage cup.

4. The beverage cup lid as in claim 1, further comprising:

wherein the aroma aperture has a diameter which is approximately equal to a radial axis length of said dispensing aperture.

5. The beverage cup lid as in claim 4, further comprising:

wherein the dispensing aperture radial axis length is approximately 0.4 inches (10 mm).

6. The beverage cup lid as in claim 4, further comprising:

wherein the dispensing portion upper edge is a radiused edge, the radius being at least 0.03 inches (0.75 mm).

7. The beverage cup lid as in claim 6, further comprising:

wherein the dispensing portion upper edge is coplanar with the raised annular ridge.

8. The beverage cup lid as in claim 1, further comprising:

wherein the rounded corners have radii of approximately 0.08 inches (2 mm).

9. The beverage cup lid as in claim 1, further comprising:

wherein the dispensing portion upper edge is coplanar the raised annular ridge.

* * * * *